US006702551B2

(12) United States Patent
Kikuchi et al.

(10) Patent No.: US 6,702,551 B2
(45) Date of Patent: Mar. 9, 2004

(54) STEAM TURBINE

(75) Inventors: Masataka Kikuchi, Chigasaki (JP); Toru Takahashi, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 10/196,144

(22) Filed: Jul. 17, 2002

(65) Prior Publication Data

US 2002/0172595 A1 Nov. 21, 2002

Related U.S. Application Data

(62) Division of application No. 09/803,028, filed on Mar. 12, 2001, now Pat. No. 6,443,695, which is a division of application No. 09/294,897, filed on Apr. 20, 1999, now Pat. No. 6,267,556.

(30) Foreign Application Priority Data

Apr. 21, 1998 (JP) ..... P10-111166

(51) Int. Cl.[7] ..... F01D 25/16
(52) U.S. Cl. ..... 415/220; 415/229
(58) Field of Search ..... 415/108, 199.5, 415/220, 229

(56) References Cited

U.S. PATENT DOCUMENTS

| | | | | |
|---|---|---|---|---|
| 3,630,635 A | | 12/1971 | Fatum | |
| 3,640,639 A | | 2/1972 | Ruhl | |
| 3,764,226 A | | 10/1973 | Matto | |
| 3,948,054 A | | 4/1976 | Lardi et al. | |
| 4,325,670 A | | 4/1982 | Silvestri, Jr. | |
| 4,557,664 A | * | 12/1985 | Tuttle et al. | 415/105 |
| 4,592,204 A | * | 6/1986 | Rice | 60/792 |
| 4,744,726 A | | 5/1988 | Remberg | |
| 4,780,057 A | | 10/1988 | Silvestri, Jr. | |
| 4,961,310 A | * | 10/1990 | Moore et al. | 60/39.182 |
| 5,080,558 A | | 1/1992 | Tran | |
| 5,191,764 A | | 3/1993 | Silvestri, Jr. | |
| 5,411,365 A | | 5/1995 | Mazzola et al. | |
| 5,536,146 A | | 7/1996 | Siga et al. | |
| 6,074,169 A | | 6/2000 | Siga et al. | |
| 6,174,132 B1 | | 1/2001 | Shiga et al. | |
| 6,267,556 B1 | * | 7/2001 | Kikuchi et al. | 415/176 |

FOREIGN PATENT DOCUMENTS

| | | |
|---|---|---|
| JP | 3-130502 | 6/1991 |
| JP | 6-159009 | 6/1994 |

OTHER PUBLICATIONS

Technical Report of "Development and Design Features of Single Cylinder Reheat Turbine Plant," vol. 17, No. 2, Published Mar. 1980 from Mitsubishi Juko Kabushiki Kaisha by T. Fujita et al.

* cited by examiner

*Primary Examiner*—Ninh H. Nguyen
(74) *Attorney, Agent, or Firm*—Finnegan, Henderson, Farabow, Garrett & Dunner, L.L.P.

(57) ABSTRACT

A steam turbine includes a turbine casing, in which a turbine rotor is accommodated so as to extend along a direction of flow of steam, and a plurality of turbine pressure sections are mounted to the turbine rotor, which includes, in combination, at least two or more of a turbine high pressure portion, a turbine intermediate pressure portion and a turbine low pressure portion. The turbine casing is divided into two casing sections, each of the divided turbine casing sections being further divided into a turbine casing upper half and a turbine casing lower half, and the turbine casing lower halves of the divided turbine casing sections being connected to each other by a fastening member such as stud bolt inserted from a side of the turbine low pressure portion.

4 Claims, 17 Drawing Sheets

STEAM TURBINE

This is a division of Application No. 09/803,028, filed Mar. 12, 2001, now U.S. Pat. No. 6,443,695 which is a division of Application No. 09/294,897, filed Apr. 20, 1999 (now U.S. Pat. No. 6,267,556 B1, issued Jul. 31, 2001), all of which are incorporated herein by reference.

BACKGROUND OF THE INVENTION

The present invention relates to a steam turbine in which two or more turbine pressure sections including a high pressure turbine, an intermediate pressure turbine and a low pressure turbine are combined and accommodated into one turbine casing.

In a conventional steam turbine, in order to increase an output power thereof, a turbine casing is divided into a high pressure turbine casing, an intermediate pressure turbine casing and a low pressure turbine casing, and a turbine rotor (turbine shaft) provided with a turbine nozzle and a turbine movable blade are accommodated in each of the casings to constitute a high pressure turbine section, an intermediate pressure turbine section and a low pressure turbine section, and the turbine rotors of the respective turbine sections are directly connected in their shafts in so-called a power train connection for operation.

If the high, intermediate and low pressure turbines are arranged as the power train, although depending on its output power, the steam turbine has a long span of at least about 30 m or longer. Therefore, two or more of the high, intermediate and low pressure turbines are combined and accommodated in one casing to shorten the span, thereby realizing a so-called high-low (high-and-low) pressure integrated type turbine or a high-intermediate (high-and-intermediate) pressure integrated type turbine.

If the steam turbine is formed into any of the high-low pressure integrated type turbine and the high-intermediate pressure integrated type turbine, the turbine rotor must inevitably handle steam having different pressures and temperatures. However, in recent years, there is realized a high-low pressure integrated turbine rotor or a high-intermediate pressure integrated turbine rotor, in which a portion of the turbine rotor which is exposed to steam having high pressure and temperature is made stronger against high-temperature, and a portion of the turbine rotor which is exposed to steam having low pressure and temperature is provided with tensile strength and toughness against low temperature by changing thermal treatment conditions.

Further, in a recent thermal power plant, there has been widely used a combined cycle power plant in which a steam turbine and a heat recovery means are combined with a gas turbine instead of a conventional power plant.

As a steam turbine applied to this combined cycle power plant, one having output power of 100 MW or more is selected in view of output power of 100 MW of a current gas turbine, the steam pressure is set to 100 kg/cm$^2$, the steam temperature is set to 500° C., the blade height of the turbine movable blade of the final stage of the lower pressure turbine is made to 36 inches or higher in a region of 50 Hz at the revolution number of 3,000 rpm and is made to 33.5 inches or higher in a region of 60 Hz at the revolution number of 3,600 rpm. In this case, since the steam turbine is made into a so-called single-shaft type turbine in which the shaft is directly coupled to the gas turbine, the high-low pressure integrated type or the high-intermediate pressure integrated type is employed to shorten the shaft span and to reduce the site or space required for installation.

As described above, in the combined cycle power plant, which has widely and mainly utilized instead of the conventional power plant, the number of shafts directly coupling the steam turbine to the gas turbine is made five or more to increase the total output power to 1,000 MW or greater, and the steam turbine is made into the high-low pressure integrated type or the high-intermediate pressure integrated type, and the area required for installing the five shafting, i.e. shaft-alignment, is further reduced so as to effectively utilize the site or space.

In a recent thermal power plant, even if the high-low pressure integrated type or the high-intermediate pressure integrated type is employed for a steam turbine applied to the combined cycle power plant so as to further reduce the area required for installation, there provide several problems such as followings in its structure.

(Problem 1)

For example, in the case of a steam turbine employing the high-low pressure integrated type, as shown in FIG. 10, turbine nozzles 2 and turbine movable blade 3 of the high-low pressure integrated type rotor 1 are combined to form a pressure stage 4, and the stage 4 is arranged in a multistage manner along a flowing direction of steam, and the stage 4, is accommodated in a turbine casing 5.

The turbine casing 5 is divided into a high pressure turbine casing section 6 made of cast steel and a low pressure turbine casing section 7 made of steel plate. When the low pressure turbine casing section 7 is connected to the high pressure turbine casing section 6, a high pressure turbine casing flange 9*a* and a low pressure turbine casing flange 9*b* provided downstream of a low pressure steam inlet 8 are connected with each other by means of stud bolt 10 inserted from the side of the high pressure turbine casing section 6.

The turbine casing 5 including both the high and low pressure turbine casing sections 6 and 7 is formed into a split type comprising upper half portion and a lower half portion.

In such turbine casing 5, when the high pressure turbine casing flange 9*a* which is the lower half portion and the low pressure turbine casing flange 9*b* which is the lower half portion are connected to each other, since the stud bolt 10 is inserted from the side of the high pressure turbine casing section 6, there is a problem that the low pressure steam inlet 8 constitutes an obstacle for the connecting operation, and this requires much labor for a worker.

Especially in a recent combined cycle power plant, it is required to increase both the output powers of the gas turbine and the steam turbine and to reduce the number of shaft connection or alignment to reduce the area required for installation. Accordingly, the diameter of the low pressure steam inlet 8 tends to be greater and thus, its connecting operation takes much labor for the worker, and a new or improved countermeasure has been required.

(Problem 2)

In the conventional steam turbine, as shown in FIG. 12, the turbine casing 5 has a double cylindrical structure comprising an outer (external) casing 11 and an inner (internal) casing 12, and for example, a high-intermediate pressure integrated turbine rotor 15 comprising a turbine high pressure portion 13 and a turbine intermediate pressure portion 14 is accommodated in the internal casing 12. Similarly, a low turbine casing 16 is formed into a double cylindrical structure comprising an outer casing 16*a* and an inner casing 16*b*, a low pressure turbine rotor 18 including turbine low pressure portions 17*a* and 17*b* having opposite directions of stream flow is accommodated in the inner casing 16*b*, and the low pressure turbine rotor 18 and the high-intermediate pressure integrated turbine rotor 15 are connected with each other through a coupling 19.

In the case of another type steam turbine as shown in FIG. 13, for example, the high-intermediate pressure integrated turbine rotor 15 is accommodated in the inner casing 12 as in the above case, and the low pressure turbine rotor 18 including a turbine low pressure portion 20 having a single current of steam is accommodated in the inner casing 16*b* of the low pressure turbine casing 16. In each of the low pressure turbines 16 shown in FIGS. 12 and 13, a turbine exhaust chamber 21 is formed in a cone-like recess 22 and is connected to a steam condenser (not shown).

In each of the steam turbines shown in FIGS. 12 and 13, the high-intermediate pressure integrated turbine 15 and the low pressure turbine rotor 18 are pivotally supported by three or four journal bearing 23 to elongate the spans of the turbine casings 5 and 16, and a difference in temperature (expansion work load) per one turbine stage is relatively reduced to provide a margin in design.

However, in a steam turbine of the high-low pressure integrated type applied to the combined cycle power plant, for example, the pressure of supplied steam is high, its specific volume is small and its volume flow rate is small, and therefore, the height of each of the turbine nozzle 2 and the turbine movable blade 3 is lower than that of conventional turbine. For this reason, the secondary flow loss in the steam flowing through the turbine nozzle 2 and the turbine movable blade 3 becomes greater as compared with the conventional turbine.

For example, the steam flowing through the movable blade 3*a* has pressure higher in a belly side 24 of the movable blade 3*a* than that in a back side 25 of the adjacent one 36 as shown in FIG. 11. Therefore, when the steam flow colliding against a front edge 26 of the one movable blade 3*a* becomes a secondary flow vortex SF (channel vortex) and flows to the back side 25 of the adjacent movable blade 3*b*, the secondary flow vortex involves a turbine driving steam ST (mainstream), disturbs the flow of the turbine driving steam ST, which is a cause to lower the blade efficiency.

Especially, if the blade height of each of the turbine movable blades 3*a* and 3*b* is lowered, the steam flow receives influence of boundary layers formed at the side of tips (blade tops) and root (blade root portions) of the movable blades 3*a* and 3*b*, and the flow is deteriorated, which is a cause to increase the so-called secondary flow loss. Incidentally, the blade height and the secondary flow loss have such a relation as shown in FIG. 14 that if the blade height is lower than 25 mm, the secondary flow loss is increased.

As described above, the steam turbine employing the high-low pressure integrated type has a problem that the secondary flow loss is increased and the blade efficiency is lowered as compared with a conventional turbine.

(Problem 3)

In the case of a conventional high-intermediate pressure integrated type steam turbine, if the pressure and the temperature of the supplied steam are increased, thermal stress generated in the turbine casing is increased, and a fastening force of bolt which fastens the flanges (horizontal couplings) of the turbine casing divided into the upper half portion and the lower half portion is weakened, and there is a possibility of steam leakage. Therefore, as shown in FIG. 15, the turbine casing 5 is divided, as a double structure, into the outer casing 11 and the inner casing 12, and the high-intermediate pressure integrated turbine rotor 15 including the turbine high pressure portion 13 and the turbine intermediate pressure portion 14 is accommodated in the inner casing 12 so as to moderate the thermal stress generated in each of the casings 11 and 12.

However, in the case of the recent steam turbine employing the high-intermediate pressure integrated type or high-low pressure integrated type aiming to simplify the structure and to lower the manufacturing costs, an expensive cost will be required for forming the turbine casing 5 into the double structure, which retrogresses to the requirement of the times. Therefore, it is desired to form a turbine casing of the steam turbine into a single body, but if the turbine casing is formed into the single body, there is a problem of the above-described thermal stress and a possibility of leaking the steam will be caused.

Therefore, in the steam turbine employing the high-intermediate pressure integrated type or high-low pressure integrated type, if the turbine casing is formed into the single body, it is necessary to prepare a sufficient countermeasure to moderate the above-described thermal stress and to prevent the steam leakage.

(Problem 4)

In the case of a conventional steam turbine in which a high pressure turbine rotor including a turbine high pressure portion and a low pressure turbine rotor including a turbine low pressure portion disposed so as to oppose to the high pressure turbine rotor are directly coupled to each other through their shafts, for example, as shown in FIG. 16, a crossover tube 29 is provided between a split-type high pressure turbine casing upper half 27 and a split-type low pressure turbine casing upper half 28, and the turbine exhaust gas which has been expanded by the turbine high pressure portion 13 is supplied to opposed turbine low pressure portions 17*a* and 17*b* arranged through the crossover tube 29.

In the steam turbine of this type, a steam lead tube 31 accommodating a governing valve (steam control valve) 30 is continuously and integrally formed with the high pressure turbine casing upper half 27, and the steam supplied from a steam generator such as a boiler is supplied to a turbine high pressure portion 13 while controlling the flow rate thereof in accordance with the load by the steam control valve 30.

Further, in the case of the steam turbine of this type, at the time of a periodical inspection, the high pressure turbine casing upper half 27 and the low pressure turbine casing upper half 28 are opened. However, if the crossover tube 29 and the steam lead tube 30 are provided on the high pressure turbine casing upper half 27, a tube flange heating member must be removed, a bolt of the tube flange portion must be removed, and the crossover tube 29 must be removed and repaired at the time of the periodic inspection, the inspection takes a long time, and thus, there provides a problem that an operation starting driving schedule is hindered. Especially, since the steam lead tube 30 is directly exposed to the steam of high pressure and high temperature, seizing is frequently caused on the bolt and the nut of the tube flange, and when it is required to remove them, such operation takes much labor for a worker for a long time.

Therefore, in the case of the recent steam turbine employing the high-low pressure integrated type or high-intermediate pressure integrated type, it is required to improve the structure such that at the time of the periodic inspection, the inspection can be carried out within a short time and the operation starting driving can be done more rapidly after the inspection.

(Problem 5)

In the case of a conventional steam turbine in which the high-intermediate pressure integral type and the low pressure turbine are combined for example, as shown in FIGS. 12 and 13, the shafts of the high-intermediate pressure integrated turbine rotor 15 and the low pressure turbine rotor 18 are directly coupled to each other through the coupling 19, each of the turbine rotors 15 and 18 is pivotally supported by four or three journal bearings 23 so as to enhance the rigidity of the shaft alignment.

Furthermore, in the case of a steam turbine employing the high-low pressure integrated type, for example, as shown in FIG. 17, a high-intermediate-low pressure integrated turbine rotor 32 including the turbine high pressure portion 13 and the turbine intermediate pressure portion 14 and the turbine low pressure portion 20 is pivotally supported by the journal bearings 34*a* and 34*b* placed on bases 33*a* and 33*b* so as to provide the margin in design for rigidity of the shaft arrangement. In the steam turbine of this type, a turbine exhaust chamber 21 of the turbine low pressure portion 20 is formed in the cone-shaped recess 22 so as to secure a place for installing the journal bearing 34.

In generally, in the case of the steam turbine, if the pressure and the temperature of the supplied steam are increased and its output power is increased, since the number of stages each comprising a combination of the turbine nozzle and the movable blade is increased to cope with such increased output power, the span of the bearing of the turbine rotor tends to be longer. Therefore, in the case of the high-intermediate-low pressure integrated turbine rotor 32 provided at its single shaft with the turbine high pressure portion 13 and the turbine intermediate pressure portion 14 and the turbine low pressure portion 20, the bearing span is elongated, and if the bearing span is represented by S and the shaft diameter of the high-intermediate pressure integrated turbine rotor 32 is represented by $D_o$, as the ratio $S/D_o$ of the shaft diameter to the bearing span is increased, the rigidity of the shaft is lowered, the characteristic value of the shafting of this kind, e.g., the critical speed is lowered, and the probability of generation of the shaft vibration is increased.

Especially, in the case of a steam turbine applied to the combined power plant under the condition that the steam pressure is 100 kg/cm$^2$, the steam temperature is 500° C. and the output power is 100 MW or greater, and the height of a turbine movable blade of the final stage of the turbine low pressure portion 20 in the region of 50 Hz at the revolution number of 3,000 rpm is designed to be 36 inches or more, and the height in the region of 60 Hz at the revolution number of 3,600 rpm is designed to be 33.5 inches or more, there are problems that the additional weight due to employment of long blade as the high-intermediate-low pressure integrated turbine rotor 32 having the elongated bearing span is added, the critical speed is further lowered, and the secondary critical speed approaches the rated revolution speed, and the detuning becomes difficult.

(Problem 6)

The conventional turbine low pressure portions 17*a*, 17*b* and 20 shown in FIGS. 12, 13 and 17 are formed in the cone-shaped recess 22 for securing the installation place for the journal bearings 23 and 34*b*. However, if they are formed in the cone-shaped recess 22, the expanded turbine exhaust gas from the turbine low pressure portions 17*a*, 17*b* and 20 collides against the casing wall surface 35, providing a problem that the turbine exhaust gas loss is increased. In this case, in order to suppress the turbine exhaust gas loss of the turbine exhaust chamber 21 to a low level while keeping the shape of the cone-shaped recess 22, it is necessary to secure the axial length of the turbine exhaust chamber 21 so that the flow rate is sufficiently lowered until the turbine exhaust gas collides against the casing wall surface 35.

However, if the axial length of the turbine exhaust chamber 21 is sufficiently secured, the bearing span of the high-intermediate-low pressure integrated turbine rotor 15 or the high-intermediate-low pressure integrated turbine rotor 32 is further elongated, the rigidity of the shaft alignment is lowered and, accordingly, the characteristic value of the shaft arrangement, e.g., the critical speed is lowered, which is a cause of generation of the shaft vibration. If the shaft diameter is increased to prevent the shaft from vibrating, there is a problem of rubbing due to steam leakage or contact with labyrinth.

As described above, if the shape of the conventional turbine exhaust chamber 21 is formed into the cone-like recess 22 shape, there are provided several problems mentioned above, and it is necessary to improve the shape of the turbine elements while securing the installation place for the journal bearings 23 and 34*b*.

SUMMARY OF THE INVENTION

The present invention has been accomplished in view of the above circumstances, and it is a primary object of the invention to provide a steam turbine capable of improving the connection working of a high-intermediate pressure integrated turbine casing and a low pressure turbine casing accommodating a high-intermediate-low pressure integrated turbine rotor.

It is another object of the present invention to provide a steam turbine capable of suppressing, to a low level, the increase in the secondary flow loss which is caused by the fact that the pressure and the temperature of a turbine driving steam are increased and the blade height of a turbine movable blade is lowered as compared with a conventional turbine.

It is a further object of the present invention to provide a steam turbine capable of making strong the fastening force of a bolt when a turbine casing is divided into an upper half and a lower half and the divided upper and lower halves are connected to each other by the bolt for forming the turbine casing in which a high-intermediate-low pressure integrated turbine rotor or a high-intermediate pressure integrated turbine rotor into a single body.

It is a still further object of the present invention to provide a steam turbine capable of easily removing a turbine casing at the time of a periodic inspection.

It is a still further object of the present invention to provide a steam turbine capable of suppressing a shaft from vibrating to a low level and suppressing a turbine exhaust gas loss of a turbine exhaust chamber to a low level.

These and other objects can be achieved according to the present invention by providing, in one aspect, a steam turbine comprising:

a turbine casing;

a turbine rotor accommodated in the turbine casing so as to extend along a direction of flow of steam; and a plurality of turbine pressure sections to be mounted to the turbine rotor including, in combination, at least two or more of a turbine high pressure portion, a turbine intermediate pressure portion and a turbine low pressure portion, wherein the turbine casing is divided into two casing sections, each of the divided turbine casing sections being further divided into a turbine casing upper half and a turbine casing lower half, the turbine casing lower halves of the divided turbine casing sections being connected to each other by a fastening member such as stud bolt inserted from a side of the turbine low pressure portion.

In another aspect, there is provided a steam turbine comprising:

a turbine casing;

a turbine rotor accommodated in the turbine casing so as to extend along a direction of flow of steam; and a plurality of turbine pressure sections to be mounted to the turbine rotor including, in combination, at least two or more of a turbine high pressure portion, a turbine intermediate pressure portion and a turbine low pressure portion, wherein the turbine casing is divided into two casing sections, each of the divided turbine casing sections being further divided into a turbine casing upper half and a turbine casing lower half, the turbine casing upper halves of the divided turbine casing sections are connected to each other by a fastening member such as stud bolt inserted from either one of sides of the turbine high pressure portion and the turbine low pressure portion.

In a further aspect, there is provided a steam turbine comprising:

a turbine casing;

a turbine rotor accommodated in the turbine casing so as to extend along a direction of flow of steam; and a plurality of turbine pressure sections to be mounted to the turbine rotor including, in combination, at least two or more of a turbine high pressure portion, a turbine intermediate pressure portion and a turbine low pressure portion, the two or more turbine pressure portions being provided with pressure stages each including a turbine nozzle and a movable blade in combination, wherein a partial arc admission is formed to each of the pressure stages on an upstream side of a steam flow in the turbine casing.

In this aspect, coordinate axes are placed on a center of the turbine rotor and the turbine rotor is divided into first, second, third and fourth quadrants in the counterclockwise direction, the partial arc admission is formed in an angular region connecting the first and fourth quadrants. A height of each of the turbine nozzle and the movable blade in the pressure stage in which the partial arc admission is formed is set to 25 mm or more.

In a still further aspect, there is provided a steam turbine comprising:

a turbine casing;

a turbine rotor accommodated in the turbine casing so as to extend along a direction of flow of steam; and a plurality of turbine pressure sections to be mounted to the turbine rotor including, in combination, at least two or more of a turbine high pressure portion, a turbine intermediate pressure portion and a turbine low pressure portion, wherein the turbine casing is divided into two casing sections, each of the divided turbine casing sections being further divided into a turbine casing upper half and a turbine casing lower half, the turbine casing upper and lower halves of the divided turbine casing sections being formed with flanged portions respectively, and at least one of the flanged portions of the turbine casing upper and lower halves being formed with a steam passage.

In a still further aspect, there is provided a steam turbine comprising:

a turbine casing;

a turbine rotor accommodated in the turbine casing so as to extend along a direction of flow of steam; and a plurality of turbine pressure sections to be mounted to the turbine rotor including, in combination, at least two or more of a turbine high pressure portion, a turbine intermediate pressure portion and a turbine low pressure portion, wherein the turbine casing is divided into two casing sections, each of the divided turbine casing sections being further divided into a turbine casing upper half and a turbine casing lower half, the turbine casing lower halves of the divided turbine casing sections being formed with steam inlets.

In this aspect, the steam inlets includes a high pressure steam inlet portion and a low pressure steam inlet portion.

In a still further aspect, there is provided a steam turbine comprising:

a turbine casing;

a turbine rotor accommodated in the turbine casing so as to extend along a direction of flow of steam; and a plurality of turbine pressure sections to be mounted to the turbine rotor including, in combination, at least two or more of a turbine high pressure portion, a turbine intermediate pressure portion and a turbine low pressure portion, wherein the turbine rotor is supported at both longitudinal ends thereof by a high pressure side journal bearing and a low pressure side journal bearing accommodated in a bearing box in a manner that either one of the high pressure side journal bearing and the low pressure side journal bearing is overhung apart from a base to shorten a bearing span.

In this aspect, the journal bearing overhung apart from the base is the low pressure side journal bearing.

The turbine casing is provided with a steam outlet portion on a side of which a turbine exhaust chamber is formed, the turbine exhaust chamber is formed with a recess opposed to the low pressure side journal bearing, and the recess is formed in one of a convex curved surface and a pseudo curved surface toward the low pressure side journal bearing. An angle between a curved surface and a straight surface or between straight surfaces of the pseudo curved surface is set to 140° or greater.

In a still further aspect, there is provided a steam turbine comprising:

a turbine casing;

a turbine rotor accommodated in the turbine casing so as to extend along a direction of flow of steam; and a plurality of turbine pressure sections to be mounted to the turbine rotor including, in combination, at least two or more of a turbine high pressure portion, a turbine intermediate pressure portion and a turbine low pressure portion, the two or more turbine pressure portions being provided with pressure stages each including a turbine nozzle and a movable blade in combination, wherein a steam having pressure of 100 kg/cm$^2$ or higher and temperature of 500° C. or higher is supplied to at least one or more of the turbine high pressure portion, the turbine intermediate pressure portion and the turbine low pressure portion so that an output power of the steam becomes 100 MW or greater, and a height of a turbine movable blade of a final stage of the turbine lower pressure portion is made to 36 inches or more in a region at a revolution number of 3,000 rpm and is made to 33.5 inches or more in a region at a revolution number of 3,600 rpm.

According to the steam turbine of the present invention of the characters mentioned above, the turbine casing for accommodating the high-intermediate-low pressure integrated turbine rotor is divided into the high-moderate pressure integrated turbine casing and the low pressure integrated turbine casing, and these turbine casing are further divided into the turbine casing upper halves and the turbine casing lower halves, and when these turbine casings are connected, they are connected by the stud bolt to be inserted through the turbine casing lower halves from the side of the turbine low pressure portion. Therefore, there is no obstacle as compared with the conventional turbine, and it is possible to reduce the labor of the worker at the time of the connecting operation.

Furthermore, according to the steam turbine of the present invention, the pressure state having a low blade height is formed with the partial arc admission (air passage), and the height of the turbine nozzle and the turbine movable blade is set to 25 mm or higher. Therefore, it is possible to secure the volume flow rate of the turbine driving steam required for the design, it is possible to secure the stable steam flow rate and to suppress the secondary flow loss of steam to the low level.

Still furthermore, at least one of flanges of the turbine casing upper half and the turbine casing lower half of the high-intermediate pressure integrated turbine casing is formed with the steam passage, and the flanges and the connection bolt are cooled. Therefore, it is possible to moderate the thermal stress of the turbine casing upper half and the turbine casing lower half, and the turbine casings can be formed into a single body, and it is possible to reduce its weight and its size.

Still furthermore, the turbine casing for accommodating the high-low pressure integrated turbine rotor is divided into the high pressure turbine casing section and the low pressure turbine casing section, and these turbine casing sections are further divided into the turbine casing upper halves and the turbine casing lower halves, and each of the turbine casing sections is provided with the high pressure steam inlet and the low pressure steam inlet. Therefore, there is no obstacle as compared with the conventional turbine, and hence, at the time of the periodic inspection, it is possible to easily open the turbine casing upper halves of the turbine casing sections.

Still furthermore, according to the steam turbine of the present invention, at least one of the high pressure side journal bearing and the low pressure side journal bearing pivotally supporting the opposite ends of the high-intermediate-low pressure integrated turbine rotor is separated from the base and overhung so as to shorten the bearing span. Therefore, it is possible to maintain the rigidity of the shafting, i.e. shaft alignment, at the high level and to suppress the shaft vibration to the low level.

Still furthermore, the recess of the turbine exhaust chamber in the high-intermediate-low pressure integrated turbine casing is formed into the curved surface or the pseudo curved surface, it is possible to suppress the turbine exhaust gas loss to the low level to improve the rigidity of the shafting due to the shortening of the bearing span and to stably operate the steam turbine.

The nature and further characteristic features of the present invention will be made more clear from the following descriptions made with reference to the accompanying drawings.

DESCRIPTION OF THE PREFERRED EMBODIMENTS

A steam turbine according to preferred embodiments of the present invention will be described hereunder with reference to the accompanying drawings.

Figure 1:
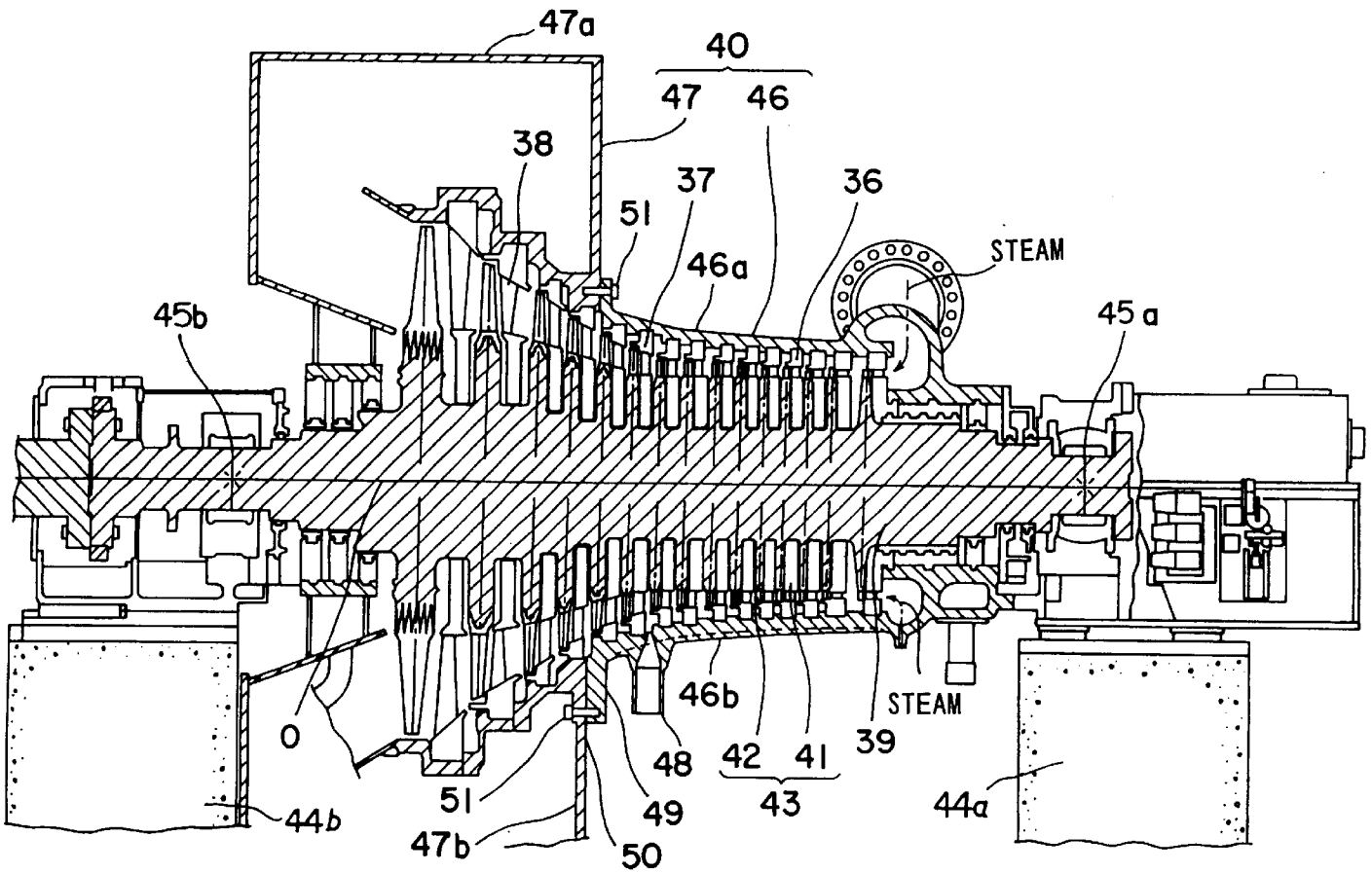
FIG. 1 is a schematic sectional view showing a first embodiment of a steam turbine of the present invention.

FIG. 1 is a schematic sectional view showing a first embodiment of a steam turbine of the present invention, and this first embodiment is applicable to solve the "Problem 1" mentioned hereinbefore encountered in the prior art.

The steam turbine according to this first embodiment is applied to a combined cycle power plant which is designed such that the height of a turbine movable blade of the final pressure state of a turbine low pressure portion (section) under the conditions that the steam pressure is 100 kg/cm$^2$ or more, the steam temperature is 500° C. or more, and the blade height is 36 inches or more in a region of 50 Hz at the revolution number of 3,000 rpm and is 33.5 inches in a region of 60 Hz at the revolution number of 3,600 rpm.

This steam turbine employs a high-intermediate-low pressure type, for example, and a turbine high pressure portion 36, a turbine intermediate pressure portion 37 and a turbine low pressure portion 38 are combined into one high-intermediate-low pressure integrated turbine rotor (turbine shaft) 39 and accommodated in a turbine casing 40. The high-intermediate-low pressure integrated turbine rotor 39 constitutes pressure stages 43 each comprising a combination of a turbine nozzle 41 and a turbine movable blade 42, and the stages 43 are arranged in a row along the direction of flow of steam, and these stages 43 are accommodated in the turbine casing 40.

The high-intermediate-low pressure integrated turbine rotor 39 is supported at its opposite ends by journal bearings 45*a* and 45*b* provided on bases (base portions) 44*a* and 44*b*.

On the other hand, the turbine casing 40 is divided into a high-intermediate pressure integrated turbine casing section 46 and a low pressure integrated turbine casing section 47 and is provided, at the side of the high-intermediate pressure integrated turbine casing section 46, with a low pressure steam inlet 48 for supplying low pressure steam to the turbine low pressure portion 38.

The high-intermediate pressure integrated turbine casing section 46 and the low pressure integrated turbine casing section 47 are further divided into split turbine casing upper halves 46*a*, 47*a* and split turbine casing lower halves 46*b*, 47*b*, respectively, and each of the upper and lower halves 46*a*, 47*a* . . . is provided with a high-moderate pressure integrated turbine casing flange 49 and a low pressure turbine casing flange 50.

When the high-intermediate pressure integrated turbine casing flange 49 and the low pressure turbine casing flange 50 of the lower halves 46*b*, 47*b* are connected to each other, they are connected by means of stud bolt 51 inserted from the turbine low pressure portion 38 in this first embodiment. The high-intermediate pressure integrated turbine casing flange 49 and the low pressure turbine casing flange 50 of the higher halves 46*a*, 47*a* are connected to each other by inserting the stud bolt 51 from the turbine low pressure portion 38 or the turbine intermediate pressure portion 37.

As described above, in this first embodiment, since the stud bolt 51 for connecting the high-intermediate pressure integrated turbine casing flange 49 and the low pressure turbine casing flange 50 of the lower halves 46*b*, 47*b* is inserted from the side of the turbine low pressure portion 38, the output power of the steam turbine is increased and in this case, even if the diameter of the low pressure steam inlet 48 is increased, there constitutes no obstacle and, thus, when the flanges are connected to each other, it is possible to reduce the labor of a worker, the fastening operation of the stud bolt 51 can reliably be carried out, and the steam leakage can surely be prevented.

Figure 2:
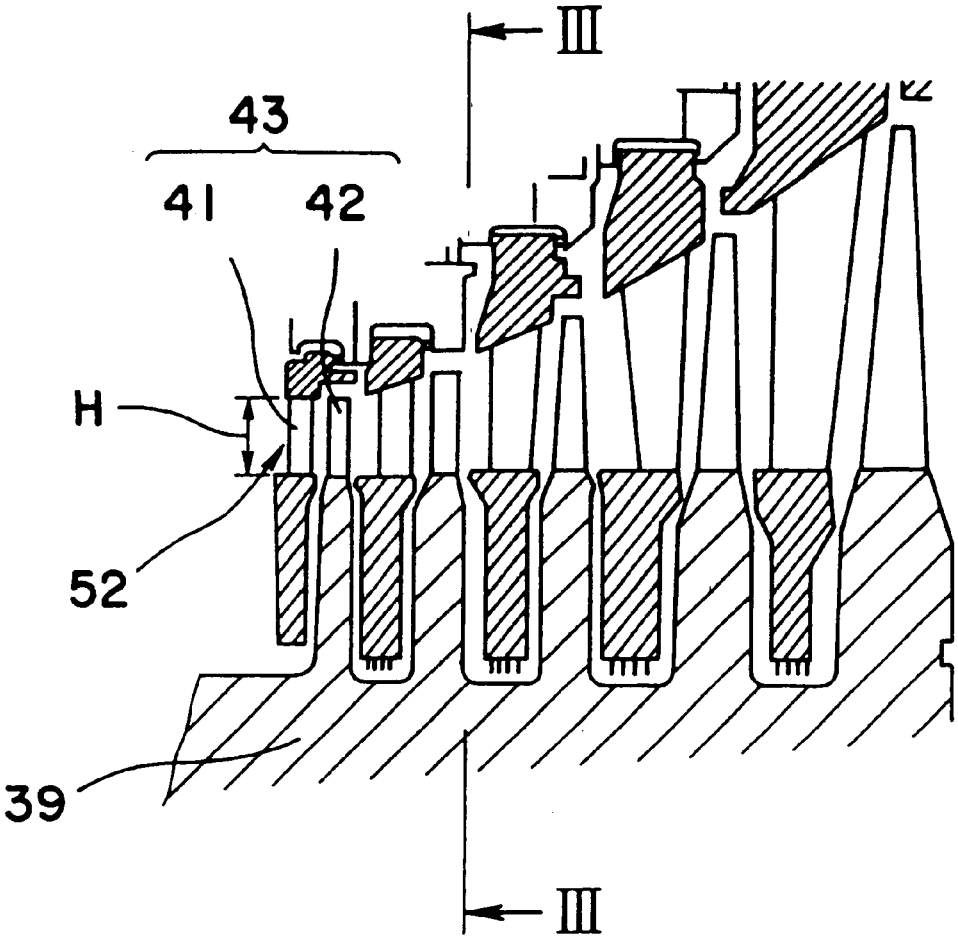
FIG. 2 is a schematic sectional view showing a second embodiment of a steam turbine of the present invention.

FIG. 2 is a schematic sectional view showing a second embodiment of a steam turbine of the present invention, in which constituent elements similar to those in the first embodiment and portions corresponding thereto are represented by the same reference numerals. This second embodiment is particularly applicable to solve the "Problem 2" encountered in the prior art mentioned hereinbefore.

In the steam turbine according to this second embodiment, among the stages 43 each comprising the combination of the turbine nozzle 41 and the turbine movable blade 42, a stage having the low blade height H is formed with a partial arc admission (air passage) 52 which is partially opened along its annular direction and the rest is closed.

In this second embodiment, if the pressure and the temperature of the steam supplied to the steam turbine are increased, its volume flow rate is reduced, and at the time of designing, the height H of each of the turbine nozzle 41 and the turbine movable blade 42 is lowered, and in this case, the secondary flow loss in the steam flow passing through the turbine nozzle 41 and the turbine movable blade 42 is increased. The second embodiment has been accomplished in view of this fact, and among the stages 43, the one stage located upstream of the steam flow is formed with the partial arc admission 52 so as to increase the height of the turbine nozzle 41 and the movable blade 42 to 25 mm or higher. In the stage located downstream of the steam flow, the height of the turbine nozzle 41 and the movable blade 42 is 25 mm or more, and therefore, the stage is formed with a full arc admission.

Figure 3:
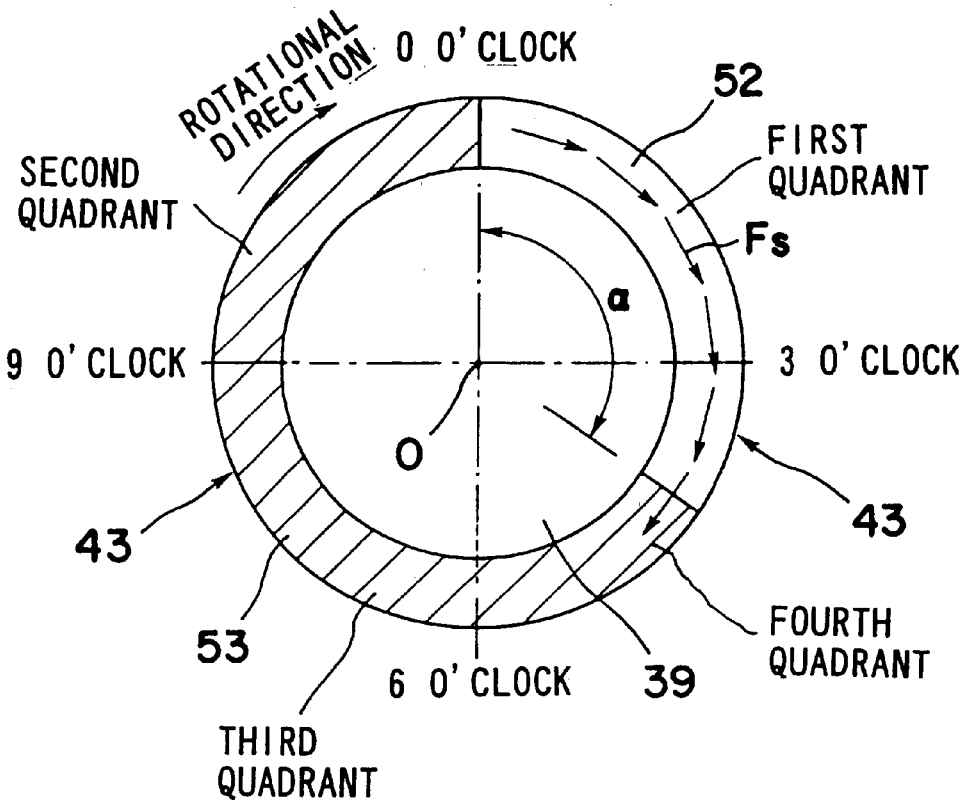
FIG. 3 is a sectional view taken along a line III—III in FIG. 2.

As shown in FIG. 3, when coordinate axes are placed on the center 0 of the high-intermediate-low pressure integrated turbine rotor 39 and the turbine rotor is divided into the first, second third and fourth quadrants in the counterclockwise direction, the partial arc admission 52 is set such that the partial arc admission angle $\alpha$ is in a region from the first to fourth quadrants in the clockwise direction. The stages 43 in the rest of the annularly formed stages are occluded with blind plates 53.

As described above, in this embodiment, since the stage located upstream of the steam flow is formed with the partial arc admission 52 such that the height H of the turbine nozzle 41 and the turbine movable blade 42 becomes 25 mm or higher so as to secure the volume flow rate required for the design thereof, it is possible to secure the stable steam flow rate and to suppress the secondary flow loss of steam to the low level.

Further, in this embodiment, the partial arc admission angle $\alpha$ of the partial arc admission is set in the range from the first to fourth quadrants in the clockwise direction so that the pushing force Fs of steam is applied toward the turbine casing lower half of the high-intermediate-low pressure integrated turbine rotor 39 and therefore, it is possible to maintain the high-intermediate-low pressure integrated turbine rotor 39 in a relatively stable state.

Figure 4:
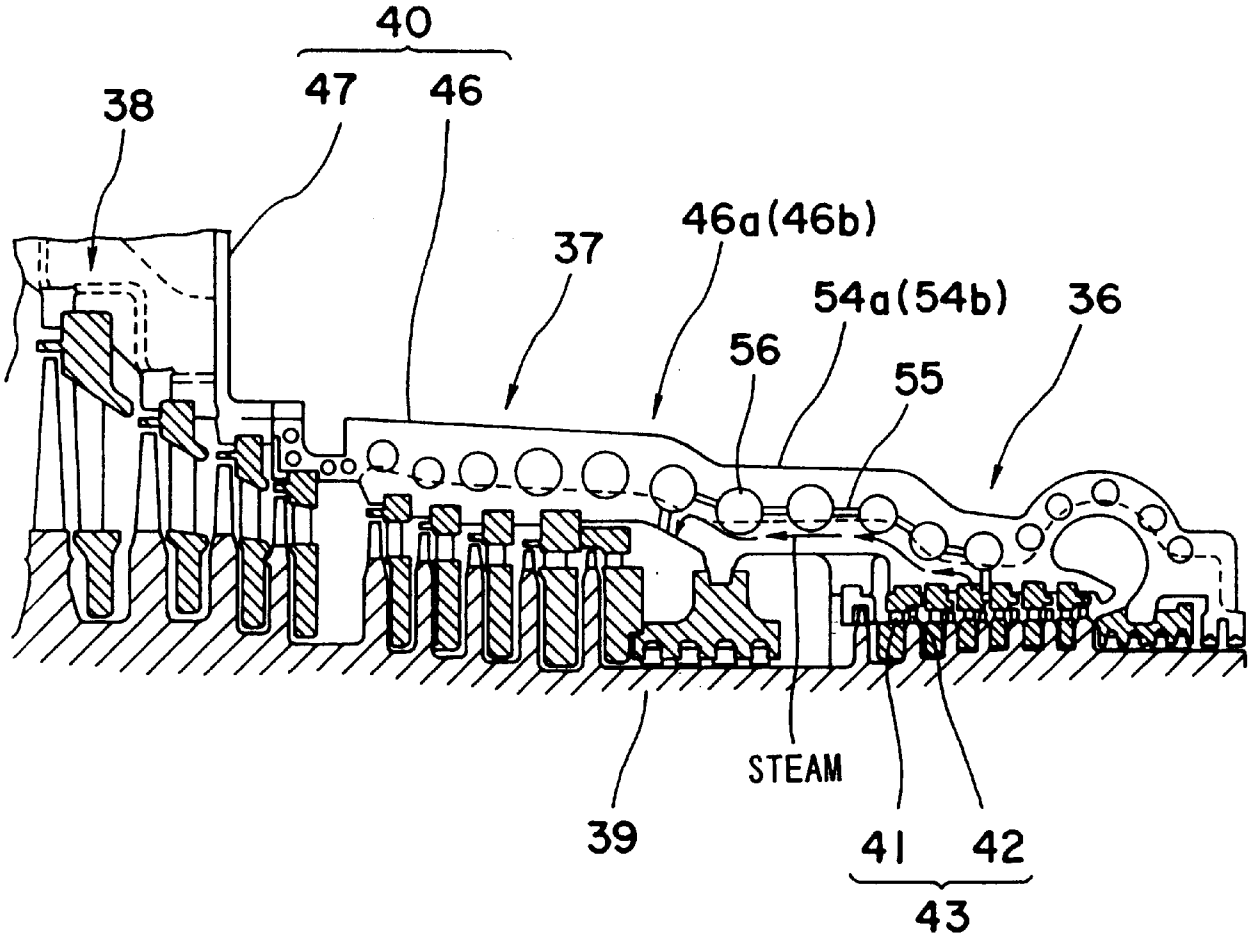
FIG. 4 is a partial sectional view showing a third embodiment of a steam turbine of the present invention.

FIG. 4 is a partial sectional view showing a third embodiment of a steam turbine of the present invention, in which constituent elements similar to those in the first embodiment and portions corresponding thereto are represented by the same reference numerals. This third embodiment represents one suitable for solving the "Problem 3" encountered in the prior art mentioned hereinbefore.

The steam turbine according to this third embodiment employs a high-intermediate-low pressure integrated type for example. A steam passage 55 is formed in at least one of flanges (horizontal couplings) 54*a*, 54*b* of the turbine casing upper halve 46*a* and the turbine casing lower halve 46*b* of the high-intermediate integrated turbine casing 46 in the high-intermediate pressure integrated turbine casing 46 and the low pressure turbine casing 47 accommodating the high-intermediate-low pressure integrated turbine rotor 39 including the stage 43 comprising the combination of the turbine nozzle 41 and the movable blade 42. The flange 54*a* of the turbine casing upper half 46*a* and the flange 54*b* of the turbine casing lower half 46*b* are cooled by flowing steam supplied from the turbine high pressure portion 36 so as to maintain the strength thereof as well as the strength of the bolt which connects the turbine casing upper half 46*a* and the turbine casing lower half 46*b*.

As described above, in this embodiment, the steam passage 55 is formed in at least one of flanges 54*a*, 54*b* of the turbine casing upper halve 46*a* and the turbine casing lower halve 46*b*, and the flanges 54*a*, 54*b* and the bolt 56 are cooled to maintain their strength at the high level. Therefore, even if the turbine casing upper half 46*a* and the turbine casing lower half 46*b* are formed into a single casing, such a single casing will provide a sufficient strength and it becomes possible to prevent the steam from leaking from the gap between the flanges 54*a* and 54*b*.

Therefore, according to this embodiment, since the high-intermediate pressure integrated turbine casing 46 can be formed into the single body, the weight and size thereof can be reduced compactly, and the manufacturing cost can also be reduced.

Figure 5:
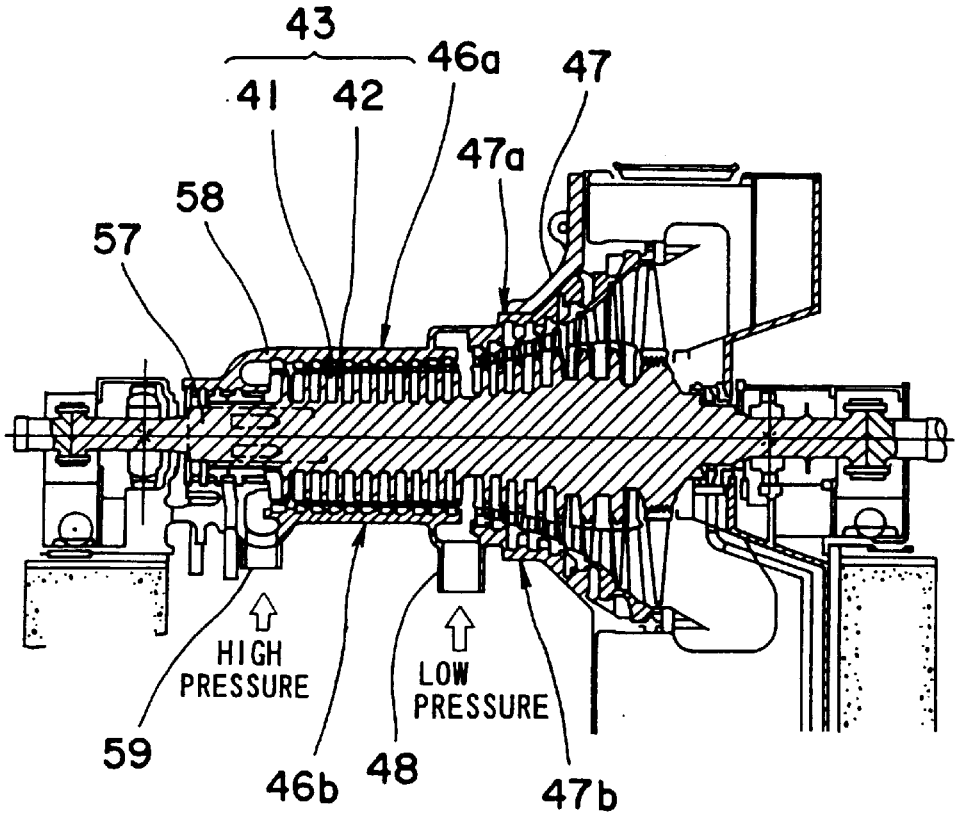
FIG. 5 is a schematic sectional view showing a fourth embodiment of a steam turbine of the present invention.

FIG. 5 is a schematic sectional view showing a fourth embodiment of a steam turbine of the present invention, in which constituent elements similar to those in the first embodiment and portions corresponding thereto are represented by the same reference numerals. This embodiment is particularly applicable to solve the "Problem 4" encountered in the prior art mentioned hereinbefore.

The steam turbine according to this embodiment employs a high-low pressure integrated type. In the low pressure turbine 47 and the high pressure turbine casing 58 for accommodating, therein, a high-low pressure integrated turbine rotor 57 having the pressure stage 43 comprising the combination of the turbine nozzle 41 and the turbine movable blade 42, the turbine casing lower halves 46*b*, 47*b* are with provided a high pressure steam inlet 59 and a low pressure steam inlet 48, respectively.

As described above, according to this embodiment, since the turbine casing lower halves 46*b*, 47*b* are provided the high pressure steam inlet 59 and the low pressure steam inlet 48, respectively. Therefore, at the time of periodic inspection, it is possible to easily remove the turbine casing upper halves 46*a*, 47*a*, and the time of the periodic inspection can be shortened.

Figure 6:
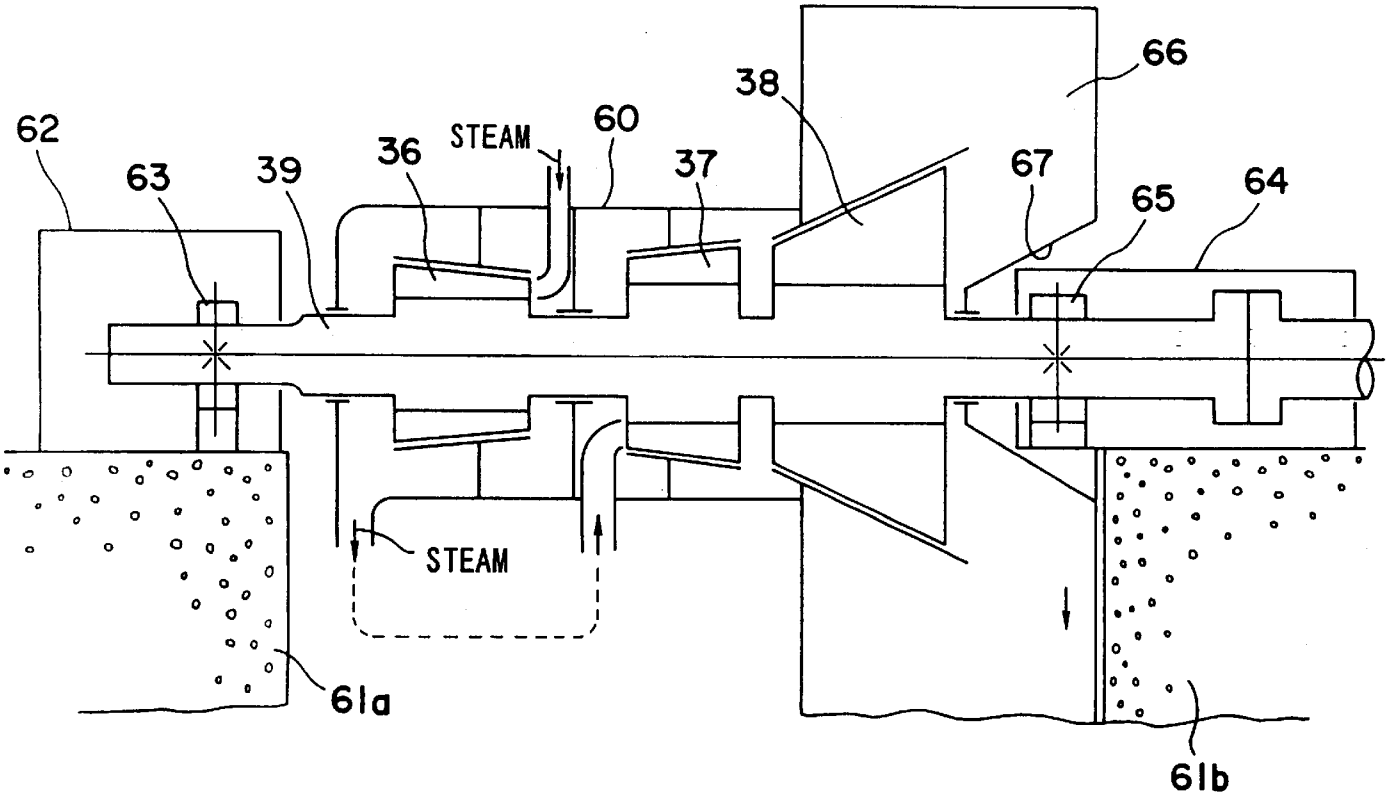
FIG. 6 is a schematic sectional view showing a fifth embodiment of a steam turbine of the present invention.

FIG. 6 is a schematic sectional view showing a fifth embodiment of a steam turbine of the present invention, in which constituent elements similar to those in the first embodiment and portions corresponding thereto are represented by the same reference numerals. This fifth embodiment is particularly suitable for solving the "Problem 5" in the prior art.

Figure 17:
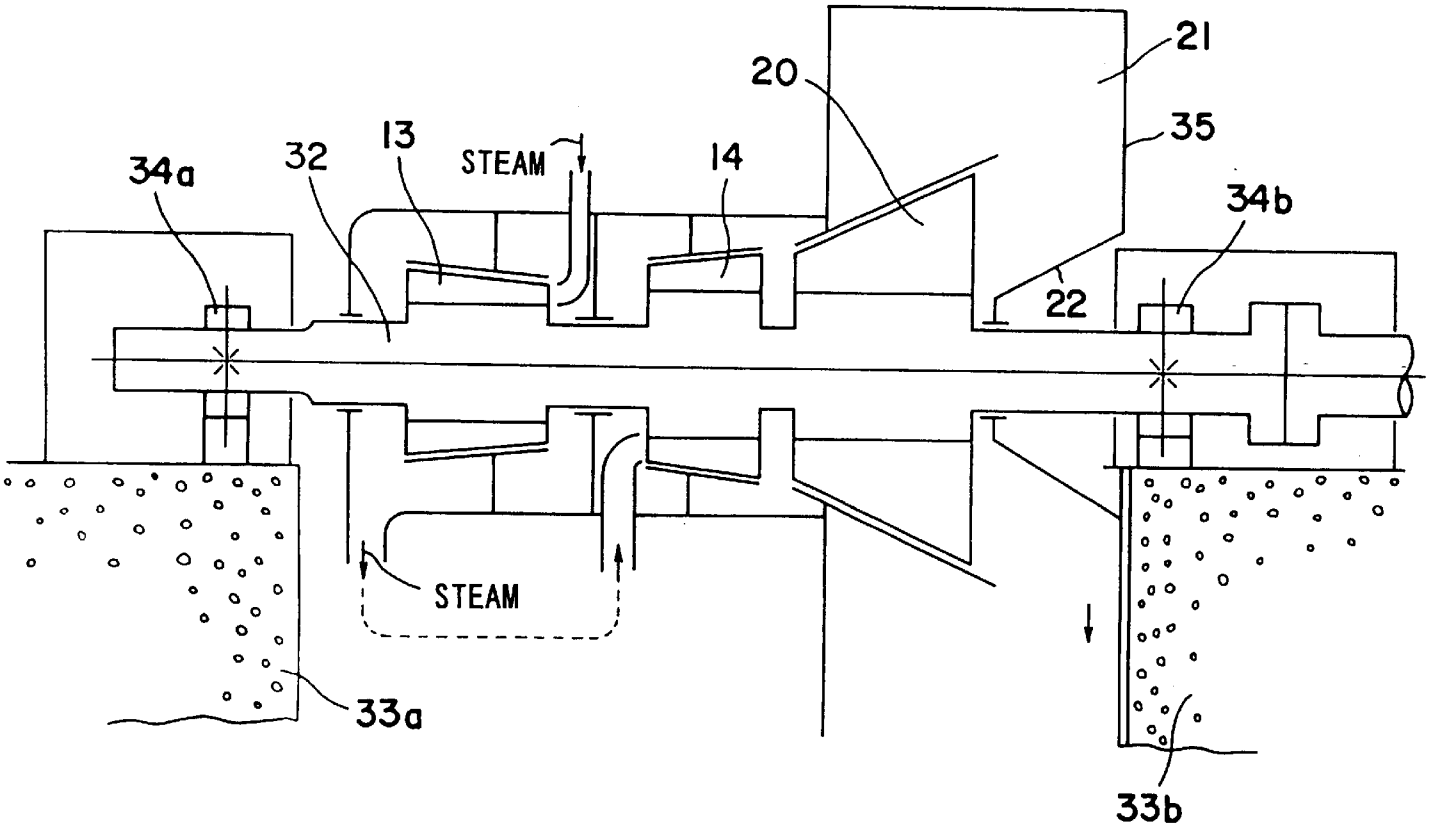
FIG. 17 PRIOR ART
FIG. 17 is a schematic sectional view showing a conventional high-intermediate-low pressure integrated type steam turbine.

The steam turbine of this fifth embodiment employs a high-intermediate-low pressure integrated type. The high-intermediate-low pressure integrated turbine rotor 39 including the turbine high pressure portion 36, the turbine intermediate pressure portion 37 and the turbine low pressure portion 38 is accommodated in the high-intermediate-low pressure integrated turbine casing 60. Between the opposite ends of the high-intermediate-low pressure integrated turbine rotor 80, one end of the high-intermediate-low pressure integrated turbine rotor 39 closer to the turbine high pressure portion 36 is pivotally supported by a high pressure side journal bearing 63 accommodated in a high pressure bearing box 62 placed on the base 61*a*, another end of the high-intermediate-low pressure integrated turbine rotor 39 closer to the turbine low pressure portion 38 is pivotally supported by a low pressure side journal bearing 65 accommodated in a low pressure bearing box 64 placed on the base 61*b*. The low pressure bearing box 64 is abutted against a cone-shaped recess 67 of an exhaust chamber 66, the low pressure side journal bearing 65 is separated and overhung from the base 61*b*, and the bearing span is made shorter than that of the conventional bearing shown in FIG. 17.

As described above, according to this embodiment, the low pressure side journal bearing 65 pivotally supporting the one end of the high-intermediate-low pressure integrated turbine rotor 39 is separated and overhung from the base 61*b*, and the bearing span of each of the high pressure side journal bearing 63 and the low pressure side journal bearing 65 is shortened. Accordingly, it is possible to improve the rigidity of the shafting to suppress the shaft vibration and to stably operate the steam turbine.

Figure 7:
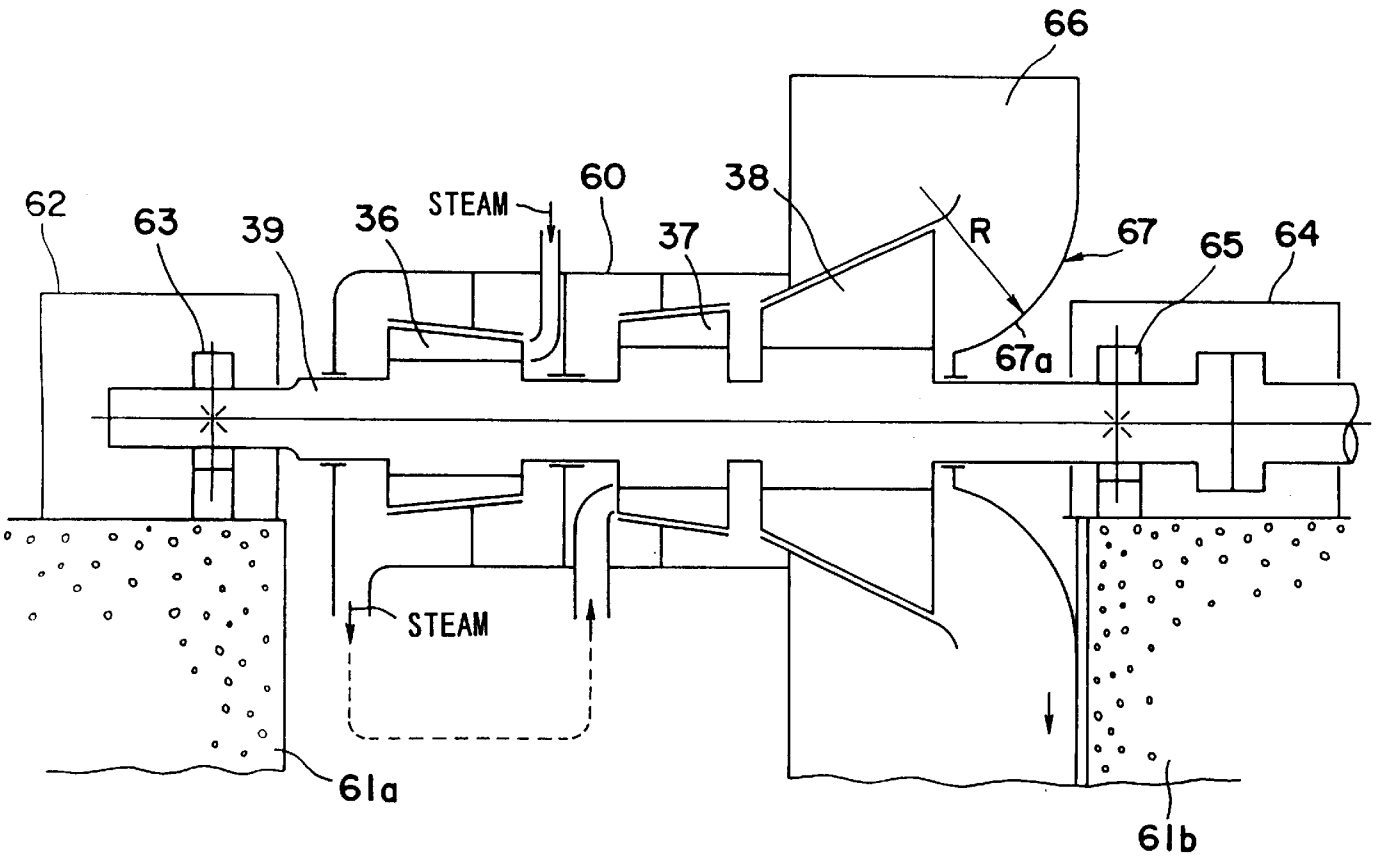
FIG. 7 is a schematic sectional view showing a sixth embodiment of a steam turbine of the present invention.

FIG. 7 is a schematic sectional view showing a sixth embodiment of a steam turbine of the present invention, in which constituent elements similar to those in the first and fifth embodiments and portions corresponding thereto are represented by the same reference numerals. This sixth embodiment is particularly suitable for solving the "Problem 6" in the prior art.

Figure 8:
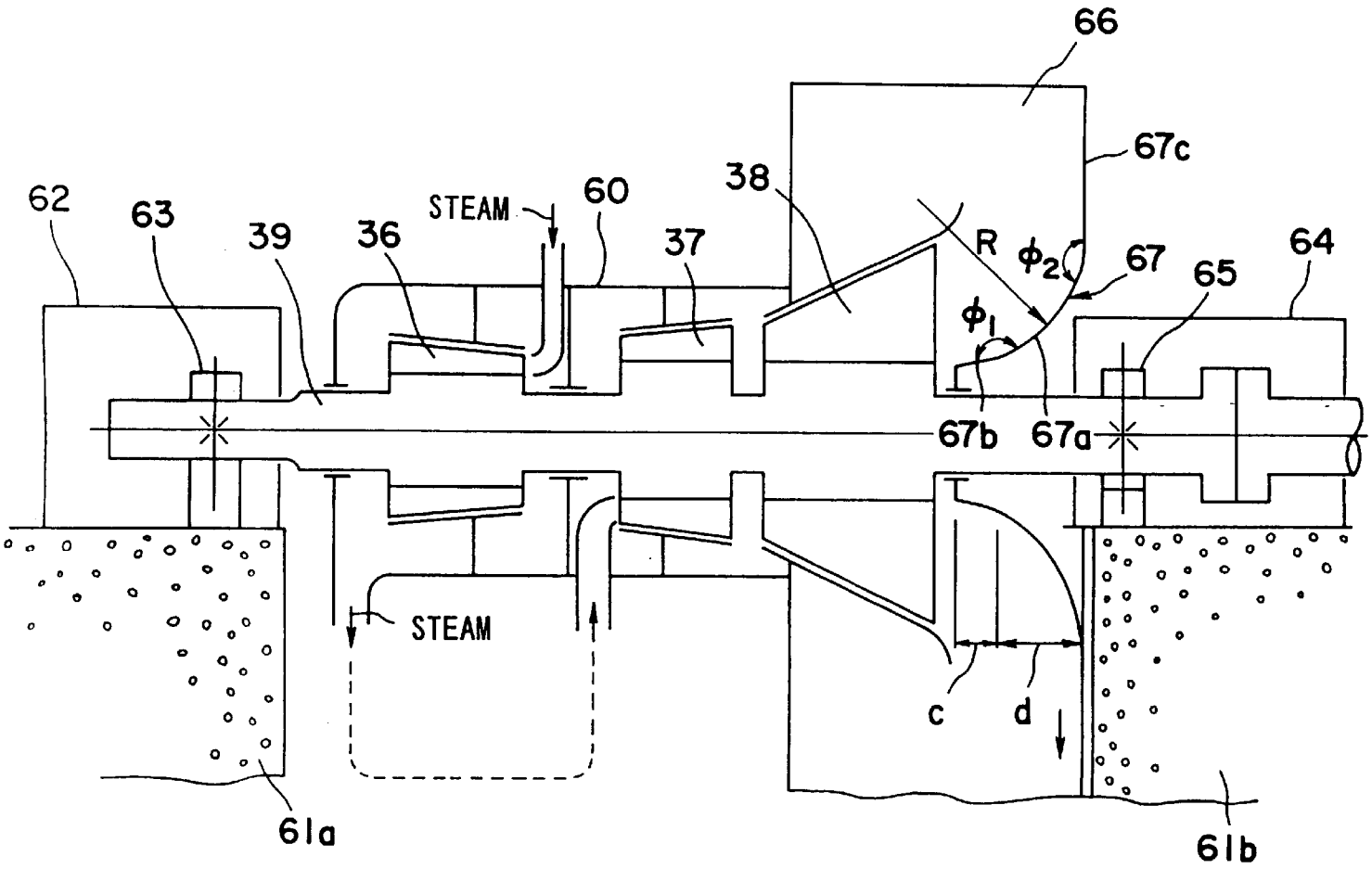
FIG. 8 is a schematic sectional view showing a first modification of the sixth embodiment.
Figure 9:
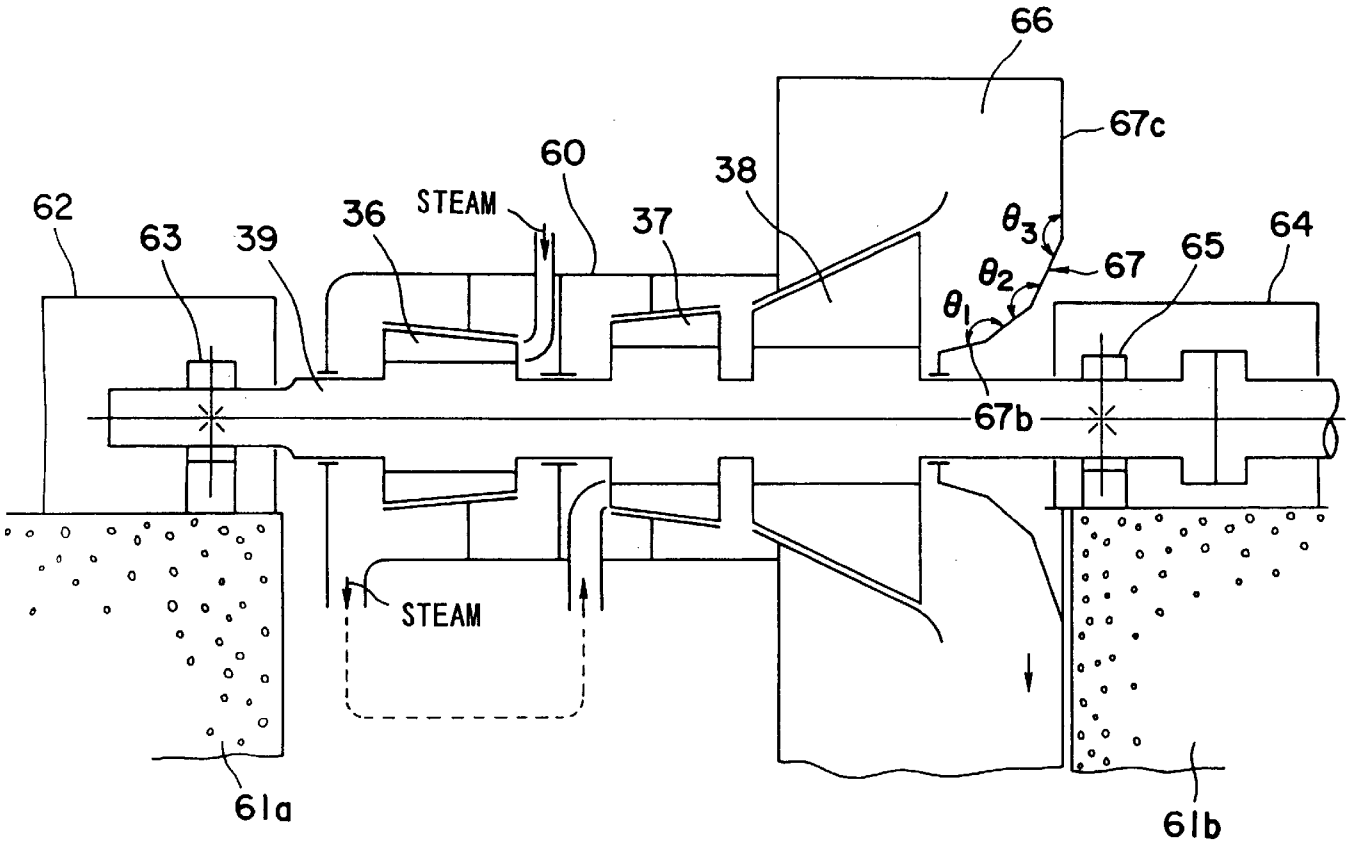
FIG. 9 is a schematic sectional view showing a second modification of the sixth embodiment.
Figure 10:
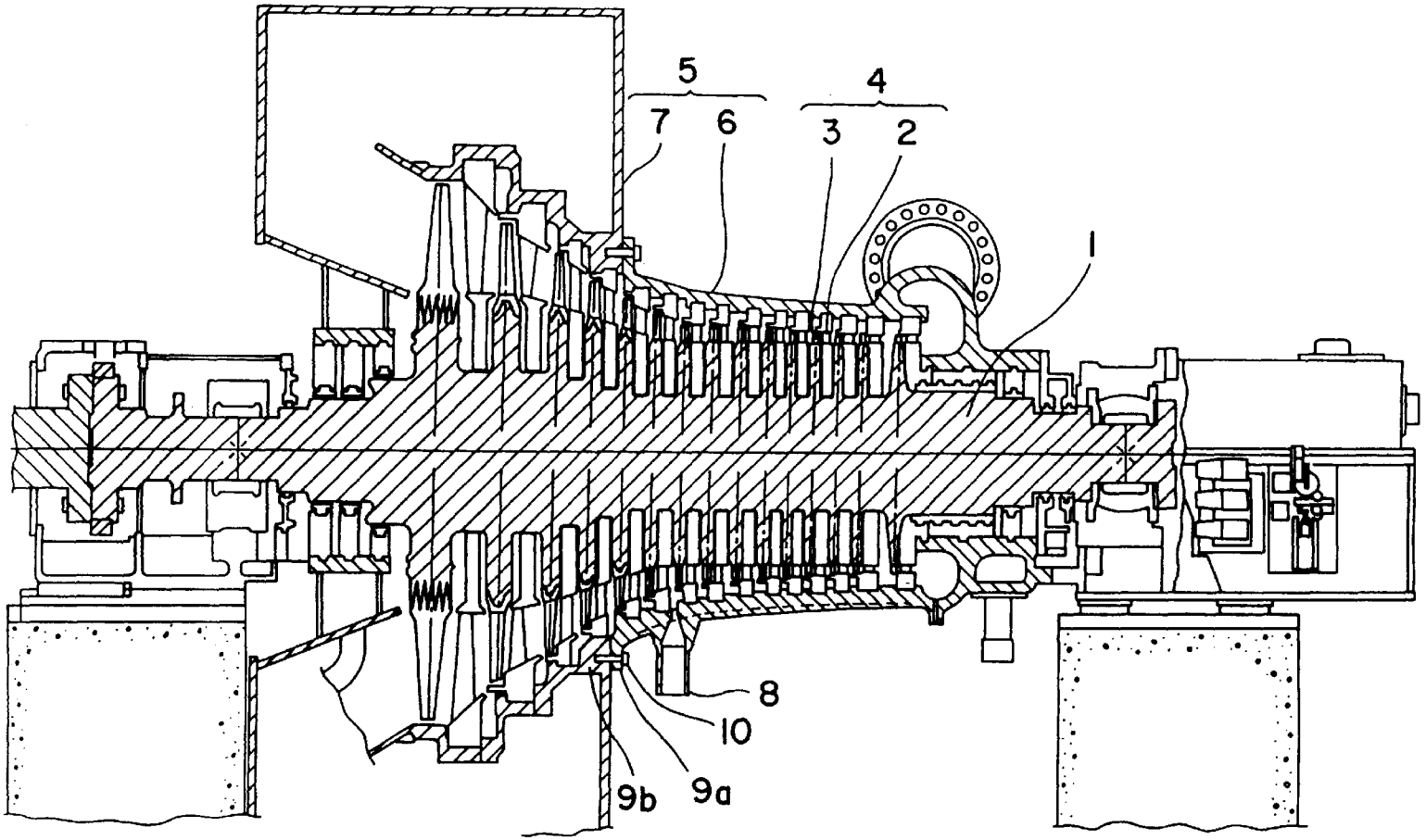
FIG. 10 is a schematic sectional view showing a conventional steam turbine.
Figure 11:
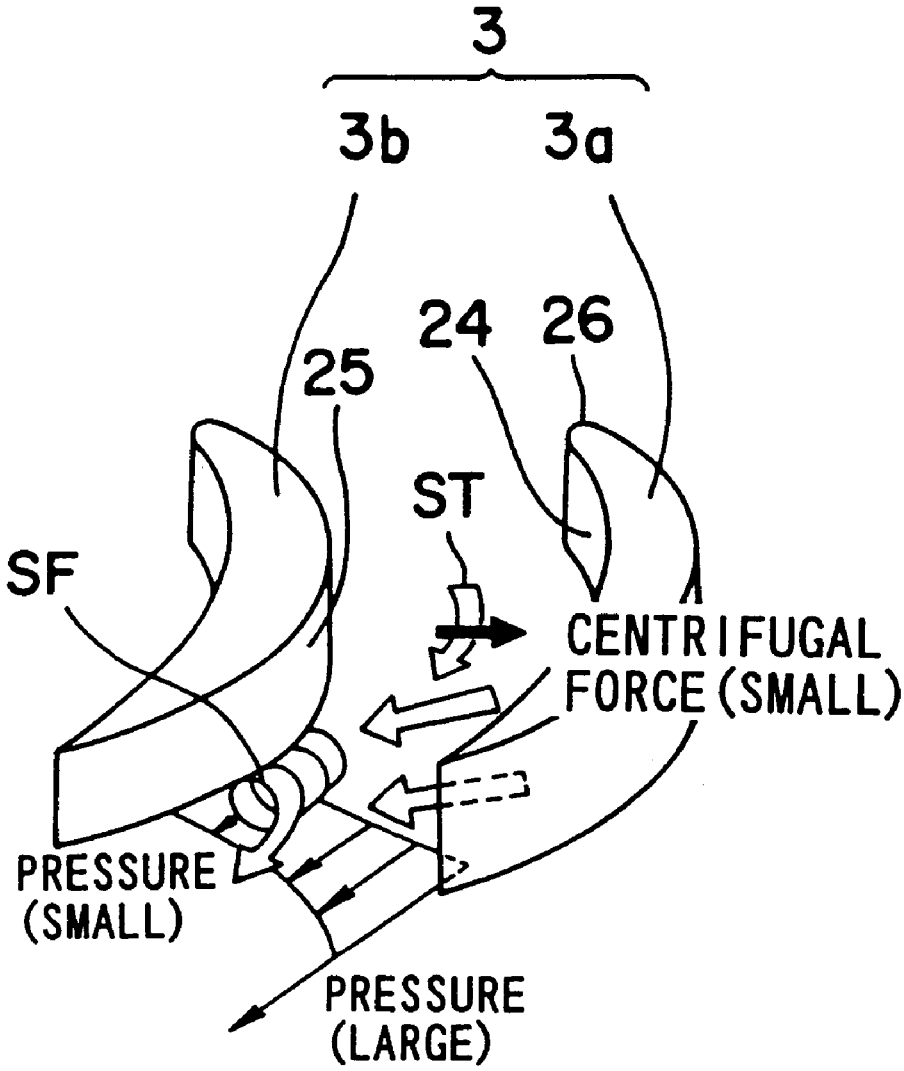
FIG. 11 is a view for explaining a secondary flow of steam flowing through a turbine movable blade.
Figure 12:
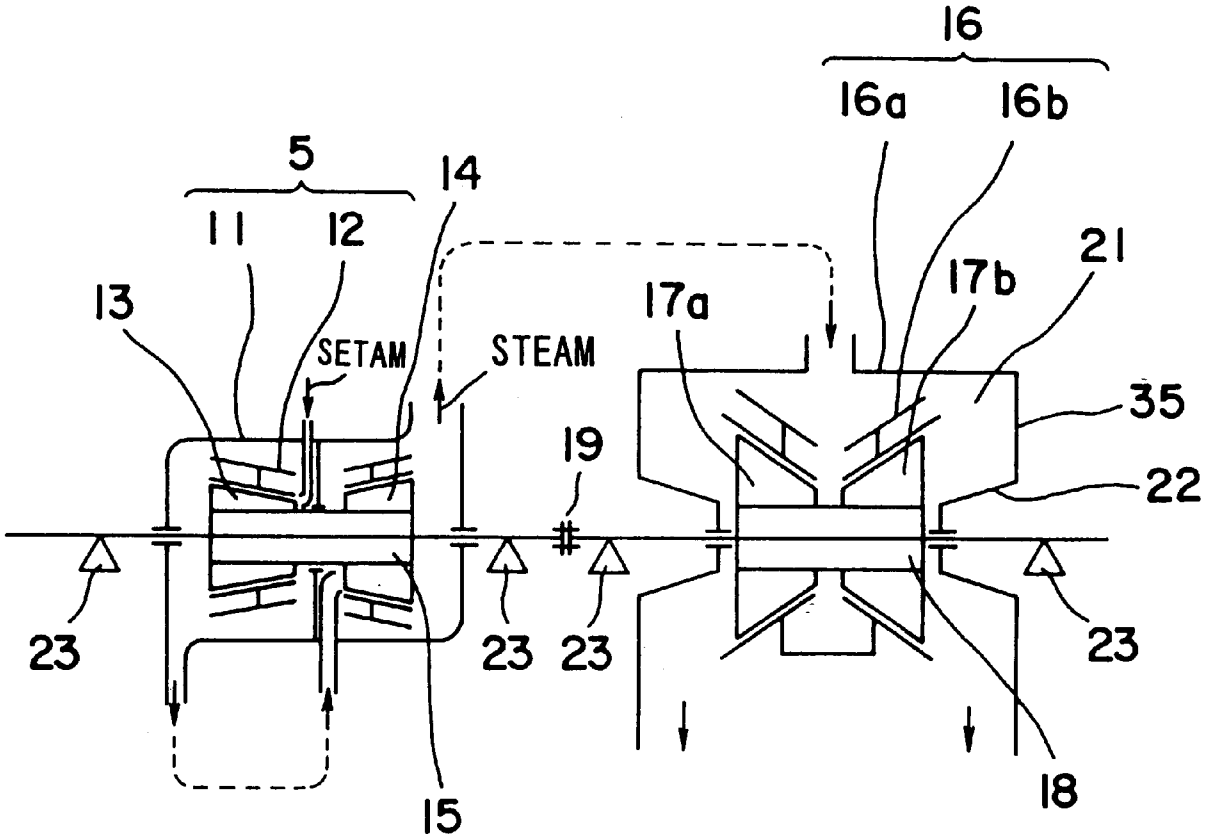
FIG. 12 PRIOR ART
FIG. 12 is a schematic sectional view of a conventional steam turbine in which a high-intermediate pressure integrated type turbine and a twin-flow type low pressure turbine are combined.
Figure 13:
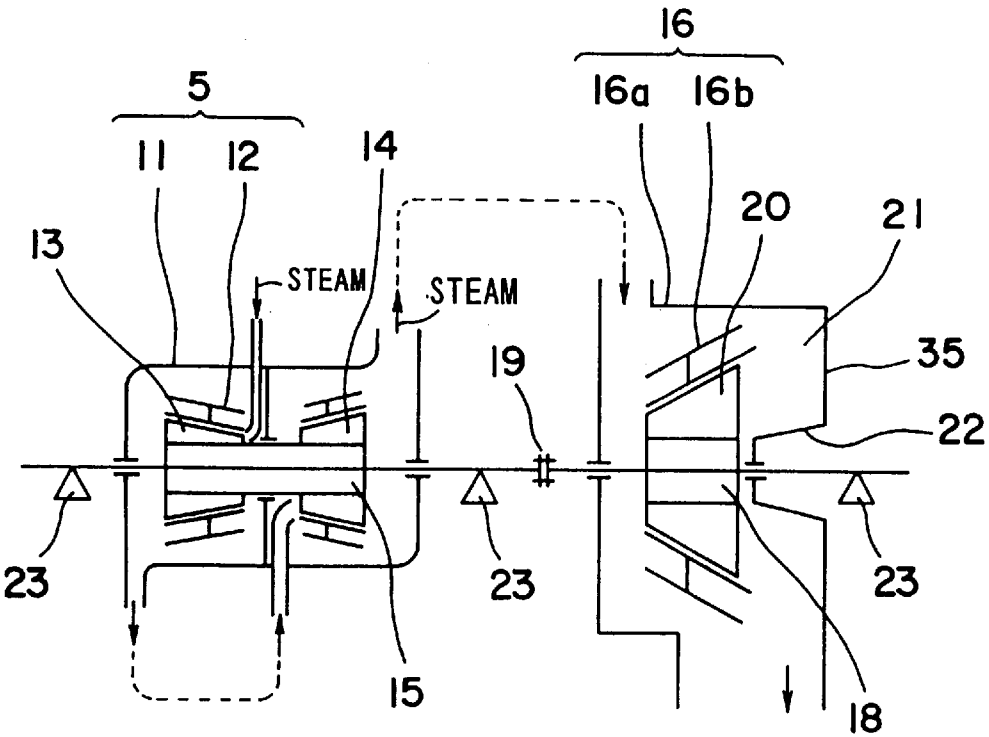
FIG. 13 PRIOR ART
FIG. 13 is a schematic sectional view of a conventional steam turbine in which a high-intermediate pressure integrated type turbine and a single-flow type low pressure turbine are combined.
Figure 14:
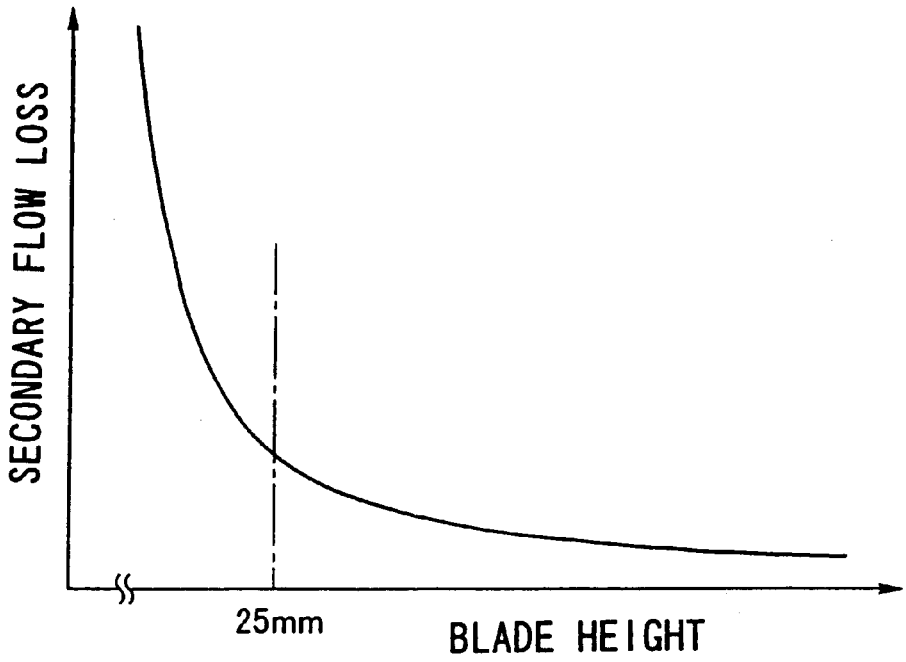
FIG. 14 PRIOR ART
FIG. 14 is a diagram of the secondary flow loss for showing a relation between the secondary flow loss and the blade height.
Figure 15:
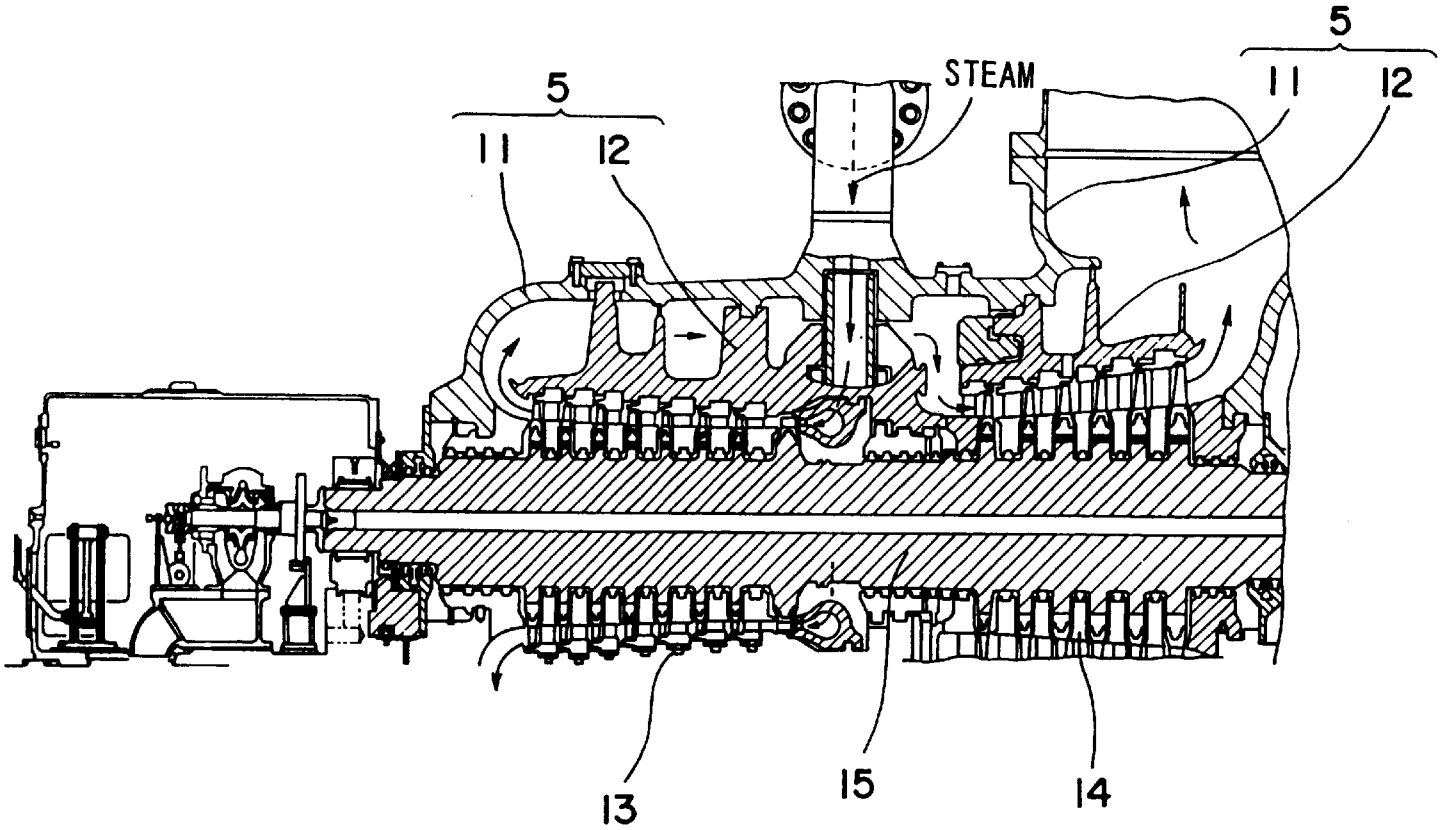
FIG. 15 PRIOR ART
FIG. 15 is a sectional view, partially cut away, showing a conventional high-intermediate pressure integrated type steam turbine.
Figure 16:
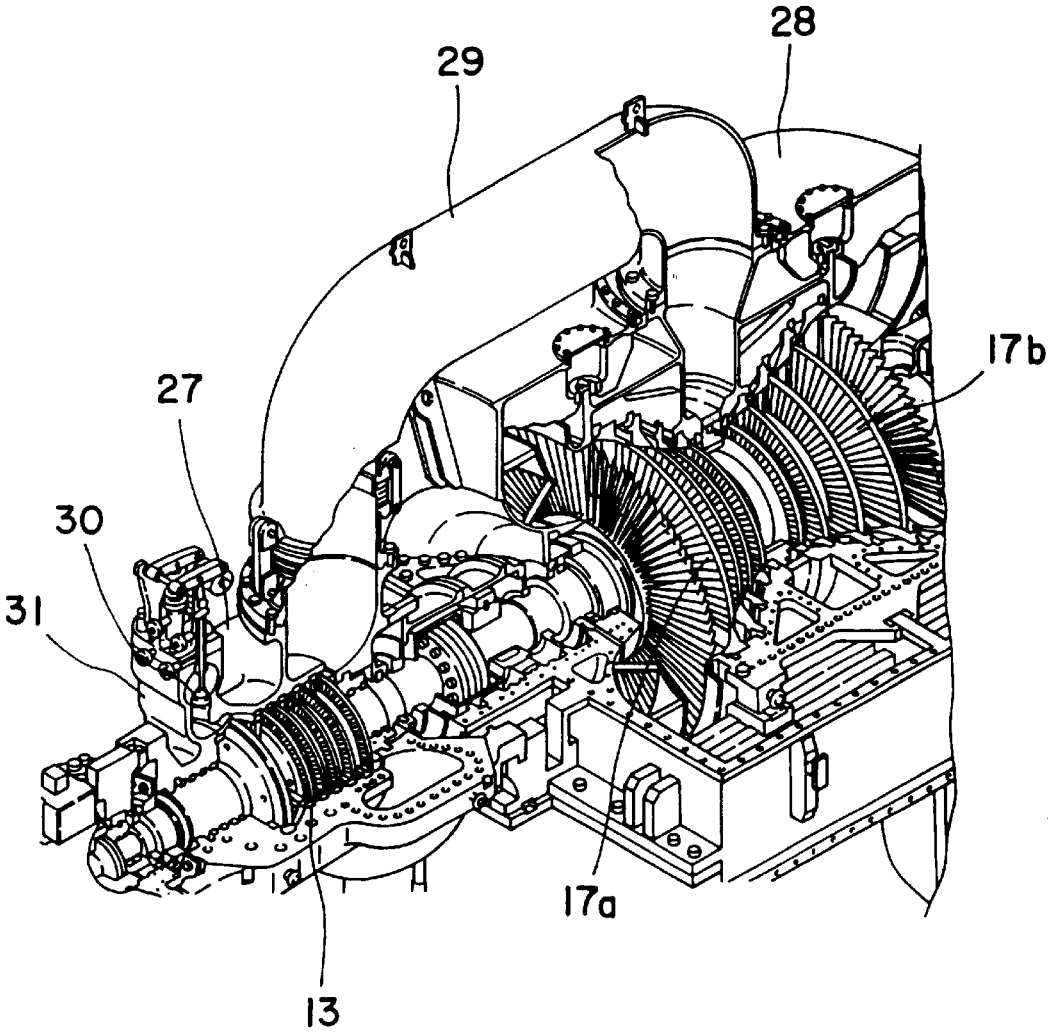
FIG. 16 PRIOR ART
FIG. 16 is a sectional view, partially cut away, showing a conventional high-low pressure integrated type steam turbine.

The steam turbine of this sixth embodiment employs a high-intermediate-low pressure integrated type. In this embodiment, the recess 67 of the turbine exhaust chamber 66 is formed into a curved surface 67*a* having curvature R which is convex toward the low pressure bearing 64. The angles $\phi$1, $\phi$2 connecting the curved surface 67*a* of the curvature R (corresponding to the length d of a projection surface) and the straight surface 67*b* (corresponding to the length c of the projection surface) may be made to 140° or greater as shown in FIG. 8, or the adjacent straight surfaces 67*b* and 67*c* may be connected to each other through continuous straight lines each having angle $\theta i$ (i=1, 2, 3, . . . ) of 140° or greater. In this case, if the angle $\phi$1, $\phi$2 or $\theta i$ formed between the adjacent surfaces of the recess 67 of the turbine exhaust chamber 66 is less than 140°, a break-away is generated in the flow of the turbine exhaust gas at such angle to increase the exhaust gas loss and, therefore, it may be better to set this angle to 140° or greater.

As described above, according to the present embodiment, since the recess 67 of the turbine exhaust chamber 66 is formed into the curved surface 67*a* or the pseudo curved surface toward the low pressure bearing box 64, it is possible to suppress the exhaust gas loss and to shorten the bearing span as compared with that of the conventional cone-shaped recess 67, and it is possible to improve the rigidity of the shafting, i.e. shaft alignment, and to stably operate the steam turbine.

It is to be noted that the present invention is not limited to the described embodiments and many other changes and modifications may be made without departing from the scopes of the appended claims.

What is claimed is:

1. A steam turbine comprising:

a turbine casing;

a turbine rotor accommodated in the turbine casing so as to extend along a direction of flow of steam; and a plurality of turbine pressure sections to be mounted to the turbine rotor including, in combination, at least two or more of a turbine high pressure portion, a turbine intermediate pressure portion and a turbine low pressure portion, wherein said turbine rotor is supported at both longitudinal ends thereof by a high pressure side journal bearing and a low pressure side journal bearing accommodated in a bearing box in a manner that either one of said high pressure side journal bearing and said low pressure side journal bearing is overhung apart from a base to shorten a bearing span.

2. A steam turbine according to claim 1, wherein said journal bearing overhung apart from said base is the low pressure side journal bearing.

3. A steam turbine according to claim 1, wherein said turbine casing is provided with a steam outlet portion on a side of which a turbine exhaust chamber is formed, said turbine exhaust chamber is formed with a recess opposed to the low pressure side journal bearing, and said recess is formed in one of a convex curved surface and a pseudo curved surface toward said low pressure side journal bearing.

4. A steam turbine according to claim 3, wherein an angle between a curved surface and a straight surface or between straight surfaces of said pseudo curved surface is set to 140° or greater.

* * * * *